US008562326B2

(12) United States Patent
Kim

(10) Patent No.: US 8,562,326 B2
(45) Date of Patent: Oct. 22, 2013

(54) ELECTROSPINNING APPARATUS FOR PRODUCING NANOFIBRES AND CAPABLE OF ADJUSTING THE TEMPERATURE AND HUMIDITY OF A SPINNING ZONE

(75) Inventor: Ha Chul Kim, Seoul (KR)

(73) Assignee: Fibrane, Co., Ltd., Incheon (KR)

( * ) Notice: Subject to any disclaimer, the term of this patent is extended or adjusted under 35 U.S.C. 154(b) by 0 days.

(21) Appl. No.: 13/501,340

(22) PCT Filed: Oct. 18, 2010

(86) PCT No.: PCT/KR2010/007123

§ 371 (c)(1),
(2), (4) Date: Apr. 11, 2012

(87) PCT Pub. No.: WO2011/118893

PCT Pub. Date: Sep. 29, 2011

(65) Prior Publication Data

US 2013/0011508 A1 Jan. 10, 2013

(30) Foreign Application Priority Data

Mar. 24, 2010 (KR) ..... 10-2010-0026447

(51) Int. Cl.
*D01D 5/098* (2006.01)

(52) U.S. Cl.
USPC ..... 425/174.8 E; 425/72.2; 425/83.1; 425/376.1; 425/461

(58) Field of Classification Search
USPC ..... 425/72.2, 83.1, 174.8 E, 376.1, 461
See application file for complete search history.

(56) References Cited

U.S. PATENT DOCUMENTS 2,810,426 A * 10/1957 Till et al. ..... 264/438
7,762,801 B2 * 7/2010 Andrady et al. ..... 425/72.2
8,052,407 B2 * 11/2011 Andrady et al. ..... 425/72.2
8,425,810 B2 * 4/2013 Ishikawa et al. ..... 264/6

FOREIGN PATENT DOCUMENTS

JP 2005-213668 A 8/2005

* cited by examiner

*Primary Examiner* — Yogendra Gupta
*Assistant Examiner* — Joseph Leyson
(74) *Attorney, Agent, or Firm* — Novak Druce Connolly Bove + Quigg LLP

(57) ABSTRACT

Provided is an electrospinning apparatus for producing nanofibers, including: a spinning solution supply unit (10); a spinning unit (30) that includes spinning nozzles (32) and a nozzle block (31) in which the spinning nozzles (32) are equidistantly arranged and supported; a nanofiber-collecting unit (40) which collects nanofibers spun from the spinning unit (30); a power supply (50) which forms an electric field in a spinning zone (Z); a process gas supply unit (20) which generates and supplies process gas to control the temperature and humidity of the spinning zone (Z) to a range appropriate for electrospinning conditions for nanofibers; and a process gas laminar flow distribution device (100) which fractionates the process gas supplied from the process gas supply unit (20), into laminar flows within the process gas laminar flow distribution device (100), and distributes the process gas from an upper portion of the spinning unit (30) to the spinning zone (Z).

12 Claims, 5 Drawing Sheets

ELECTROSPINNING APPARATUS FOR PRODUCING NANOFIBRES AND CAPABLE OF ADJUSTING THE TEMPERATURE AND HUMIDITY OF A SPINNING ZONE

TECHNICAL FIELD

The present invention relates to an electrospinning apparatus for producing nanofibers, and more particularly, to an electrospinning apparatus for providing laminar flows of process gas to a spinning zone to adjust the temperature and humidity of the spinning zone to a range appropriate for nanofiber electrospinning conditions.

BACKGROUND ART

In general, an electrospinning apparatus for producing nanofibers includes: a spinning solution (polymer solution) storage tank; a spinning solution quantitative transfer device; a nozzle block; a plurality of nozzles provided to the nozzle block; a collector for collecting nanofibers spun through the nozzles; and a power supply for applying voltage across the nozzle block and the collector.

When nanofibers are produced using such a typical electrospinning apparatus, the types of used polymer and solvent, the concentration of a polymer solution, and the temperature and humidity of a spinning room may affect the diameter of spun nanofibers and spinning efficiency. Hereinafter, the term "humidity" denotes "relative humidity".

In general, as the molecular weight of a polymer increases, the viscosity of a polymer solution increases so as to increase the diameter of spun nanofibers. Since the boiling point (volatilization temperature) of a solvent of a polymer solution affects a solidification speed of the polymer solution, the boiling point (volatilization temperature) of a solvent directly affects the diameter of nanofibers in a region (that is, a spinning zone) where nanofibers are produced from a polymer solution through a jet stream. That is, when the boiling point of a solvent is low, the solidification speed of the solvent is increased to increase the diameter of nanofibers. On the contrary, when the boiling point of a solvent is high, the diameter of nanofibers is decreased.

As the concentration of a solution increases, the surface tension and activation energy of the solution increase so as to increase the diameter of produced nanofibers. On the contrary, as the concentration of a solution decreases, the diameter of produced nanofibers is decreased.

The temperature of a region where an electrospinning process is performed (hereinafter, referred to as a "spinning zone") varies the viscosity of a spinning solution so as to change the surface tension of the spinning solution, thereby affecting the diameter of produced nanofibers.

That is, when the temperature of a spinning zone is increased to decrease the viscosity of a solution, the diameter of produced nanofibers is decreased. On the contrary, when the temperature of a spinning zone is decreased to increase the viscosity of a solution, the diameter of produced nanofibers is increased.

When the humidity of a spinning zone is increased in order to decrease the diameter of nanofibers, the volatilization speed of a solvent is decreased, which may cause a film defect that jeopardizes the cleanliness of a product. To address such a film defect, a discharge rate of a solution should be decreased, which sacrifices productivity. On the contrary, when the humidity of a spinning zone is decreased to increase productivity, the volatilization speed of a solvent is increased to increase the solidification speed of nanofibers, thus increasing the diameter thereof. As described above, in order to produce nanofibers having stable quality through an electrospinning process, it is important to uniformly maintain the temperature and humidity of a space where an electrospinning process is performed, that is, the temperature and humidity of a spinning zone.

Korean Patent No. 10-549140 discloses an electro-blowing spinning technology in which an air injection port is disposed around a spinning nozzle for spinning a polymer solution, to inject compressed air at high speed to nanofibers spun from the spinning nozzle.

In this case, although a typical electro-blowing spinning apparatus is appropriate to massively produce nanofibers, since injected air is within in a turbulence flow region and a transition range, an air turbulence may occur in a spinning zone to thereby destabilize the solidification speed of nanofibers. As a result, the diameter and diameter variation of produced nanofibers are increased as illustrated in FIGS. 7 and 8.

When nanofibers having uniform diameters are produced using a typical electrospinning apparatus, the entire temperature and humidity of a spinning room should be uniformly maintained according to predetermined conditions. To this end, an air conditioner system is installed on the spinning room. However, such air conditioner systems increase equipment and energy costs.

DISCLOSURE OF THE INVENTION

Technical Problem

An object of the present invention is to provide an electrospinning apparatus for efficiently producing nanofibers having uniform diameters, which adjusts laminar flows of process gas to constant temperature and humidity so as to control the temperature and humidity of a spinning zone.

Another object of the present invention is to provide an electrospinning apparatus for producing nanofibers, which prevents nanofibers spun from an end of a spinning nozzle from moving backward and adhering to a nozzle block.

Technical Solution

According to the present invention, an electrospinning apparatus for producing nanofibers includes: a spinning solution supply unit for supplying a spinning solution formed by dissolving a nanofiber source in a solvent; a spinning unit that includes a plurality of spinning nozzles for spinning the spinning solution from the spinning solution supply unit to a spinning zone under the spinning unit, and a nozzle block in which the spinning nozzles are equidistantly arranged and supported; a nanofiber-collecting unit facing the spinning nozzles of the spinning unit to collect nanofibers spun from the spinning unit; a power supply which forms an electric field in the spinning zone between the spinning unit and the nanofiber-collecting unit to apply electrical tensile force to the nanofibers spun from the spinning unit; a process gas supply unit which generates and supplies process gas to control temperature and humidity of the spinning zone to a range appropriate for electrospinning conditions for nanofibers; and a process gas laminar flow distribution device which fractionates the process gas supplied from the process gas supply unit, into laminar flows within the process gas laminar flow distribution device, and distributes the process gas from an upper portion of the spinning unit to the spinning zone.

The process gas laminar flow distribution device includes: a casing that includes an inlet for introducing the process gas from the process gas supply unit into a chamber, wherein the nozzle block of the spinning unit is disposed at an inner lower end of the casing, whereby the chamber for receiving the process gas from the process gas supply unit is formed over the spinning nozzles; and a laminar flow distribution plate which is disposed in a lower portion of the casing, and includes a plurality of discharge holes to fractionate the process gas stored in the chamber, into laminar flows, and to uniformly distribute the laminar flows to the spinning nozzles extending downward from a lower end of the nozzle block.

The process gas laminar flow distribution device further includes a middle fractionation plate, wherein the middle fractionation plate crosses an inside of the casing to divide the chamber into a first distribution chamber at an upper side thereof and a second distribution chamber at a lower side thereof, the first distribution chamber communicates with the inlet, and the middle fractionation plate includes first gas distribution holes through which the process gas from the first distribution chamber are primarily fractionated and distributed to the second distribution chamber.

The nozzle block of the spinning unit disposed within the casing is coupled to a support plate crossing an inner lower portion of the casing, and thus, is fixed within the casing, and the support plate includes through holes to discharge the process gas from the chamber to the laminar flow distribution plate.

Preferably, a distance from the laminar flow distribution plate to an end of the spinning nozzles ranges from 2 cm to 20 cm.

Preferably, the process gas supplied from the process gas supply unit is controlled to a temperature ranging from 40° C. to 70° C., and a relative humidity ranging from 20% to 50%.

Preferably, the discharge hole of the laminar flow distribution plate has a ratio of a length to a diameter, which ranges from 2 to 5.

A lower end of the casing vertically extends down to the end of the spinning nozzles so as to maintain the process gas distributed to the end of the spinning nozzles, in a laminar flow state.

Advantageous Effects

According to the present invention, process gas distributed as laminar flows to a spinning zone is used to optimally adjust the temperature and humidity of the spinning zone, thereby producing nanofibers having uniform and small diameters. In addition, since laminar flows are provided to a distribution region of process gas, that is, to a spinning zone, a solvent uniformly volatilizes, thus producing nanofibers having uniform diameters. In addition, process gas provided to the spinning zone facilitates volatilization and discharge of a solvent, thereby significantly improving productivity. Since a spinning unit is disposed within a process gas supply unit maintained at constant temperature, the temperature of a supplied solution can be uniformly maintained. Accordingly, the viscosity of the supplied solution is uniformly maintained, so as to produce nanofibers having uniform diameters. Only the temperature and humidity of a portion of a spinning room, that is, only the temperature and humidity of the spinning zone are controlled, which significantly decreases air conditioning costs than a typical method in which an air conditioner system for a spinning room is entirely operated to adjust the temperature and humidity of a spinning zone. Since a secondary distribution plate for distributing process gas to the spinning zone is spaced a certain distance from an end of a spinning nozzle, spun nanofibers can be prevented from being scattered backward and adhered to the secondary distribution plate.

MODE FOR CARRYING OUT THE INVENTION

Hereinafter, preferred embodiments of the present invention will now be described in detail with reference to the accompanying drawings.

Figure 1:
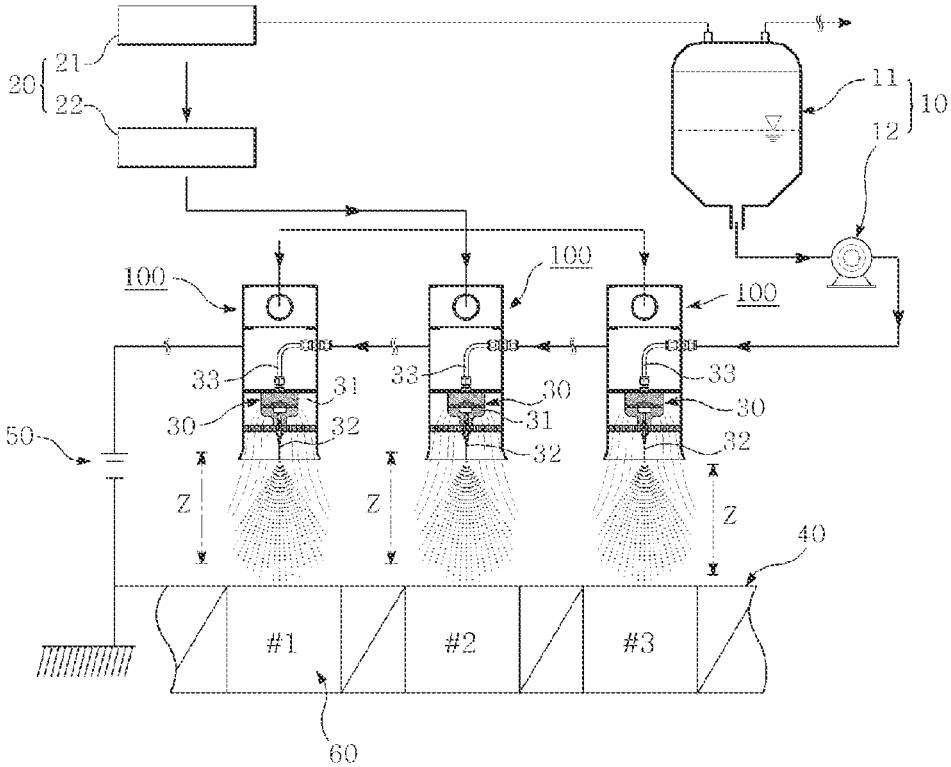
FIG. 1 is a schematic view illustrating an electrospinning apparatus for producing nanofibers according to the present invention.

Referring to FIG. 1, an electrospinning apparatus for producing nanofibers according to an embodiment of the present invention includes: a spinning solution supply unit 10 which includes a spinning solution storage tank 11 for storing a spinning solution formed by dissolving a nanofiber source in a solvent, and a quantitative supply pump 12 for quantitatively supplying the spinning solution from the spinning solution storage tank 11; a plurality of spinning units 30, each of which uses the spinning solution supplied from the quantitative supply pump 12 to spin nanofibers through spinning nozzles 32 installed on a nozzle block 31; a nanofiber-collecting unit 40 which collects the nanofibers spun through the spinning nozzles 32; a power supply 50 which applies voltage across the spinning unit 30 and the nanofiber-collecting unit 40 to form an electric field in a spinning zone Z between the spinning unit 30 and the nanofiber-collecting unit 40; and a solvent gas discharge device 60 for discharging solvent gas volatilizing from the spun nanofibers, to the outside.

As illustrated in FIG. 1, the electrospinning apparatus further includes a process gas supply unit 20. The process gas supply unit 20 generates process gas serving as atmosphere of the spinning zone Z, and controls the process gas to the range of predetermined temperature and humidity, to supply the process gas. Hereinafter, the term "process gas" denotes gas supplied to the spinning zone Z between the spinning unit 30 and the nanofiber-collecting unit 40 to adjust the temperature and humidity of the spinning zone Z. The process gas is preferably air, but is not limited thereto. Thus, examples of the process gas may include other gas than air, and gas mixed with air.

The process gas supply unit 20 includes a process gas generator 21 and an air conditioner part 22. The air conditioner part 22 controls the temperature and humidity of process gas generated from the process gas generator 21, to a range appropriate for nanofiber electrospinning, and provides the process gas to the spinning zone Z between the spinning unit 30 and the nanofiber-collecting unit 40.

According to the types of used spinning solutions, the air conditioner part 22 controls process gas to a temperature ranging from 20° C. to 100° C., preferably, from 40° C. to 70° C., and to a relative humidity ranging from 10% RH to 90% RH, preferably, from 20% RH to 50% RH.

When process gas is air, the process gas generator 21 denotes a device such as a blower fan or compressor for supplying process gas to a distribution chamber of a process gas laminar flow distribution device to be described later. The process gas generator 21 generates and supplies process gas not only to the spinning zone Z, but also to the spinning solution storage tank 11 in order to discharge a spinning solution from the spinning solution storage tank 11.

The spinning unit 30 includes the nozzle block 31 and the spinning nozzles 32 equidistantly arranged in the nozzle block 31. The spinning unit 30 receives a spinning solution from the quantitative supply pump 12 through a supply pipe 33, and discharges the spinning solution to the spinning nozzles 32 through the nozzle block 31.

As illustrated in FIG. 1, the electrospinning apparatus further includes a process gas laminar flow distribution device 100 which divides process gas supplied from the process gas supply unit 20 into laminar flows within the process gas laminar flow distribution device 100, and which distributes the process gas from an upper portion of the spinning unit 30 to the spinning zone Z.

Figure 2:
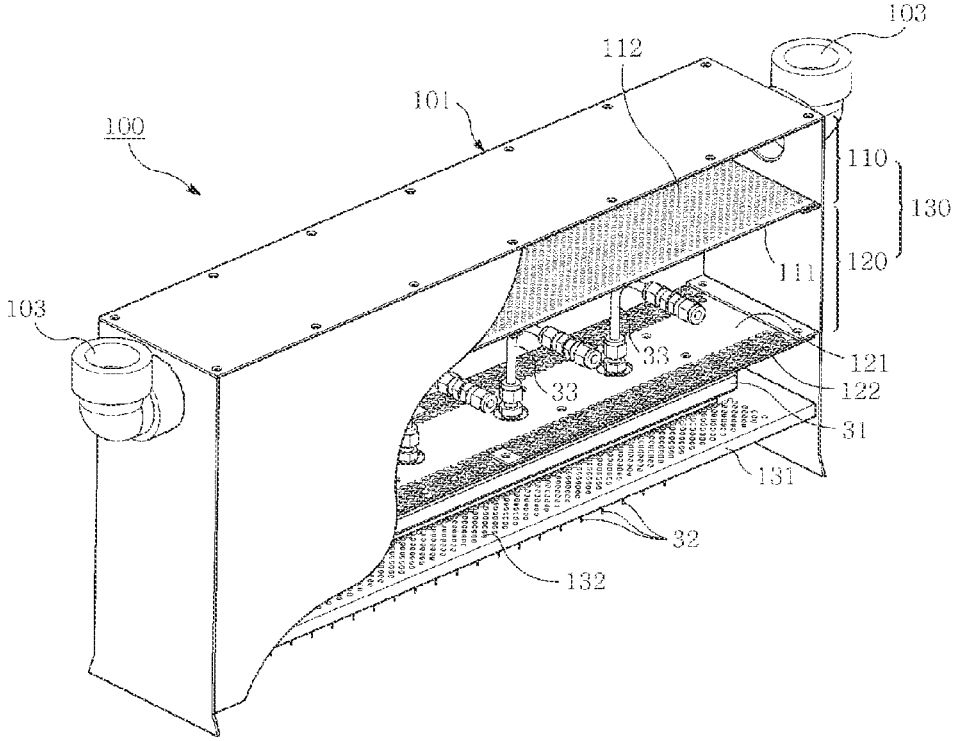
FIG. 2 is a partial cut-away perspective view illustrating a process gas laminar flow distribution device according to an embodiment of the present invention.
Figure 3:
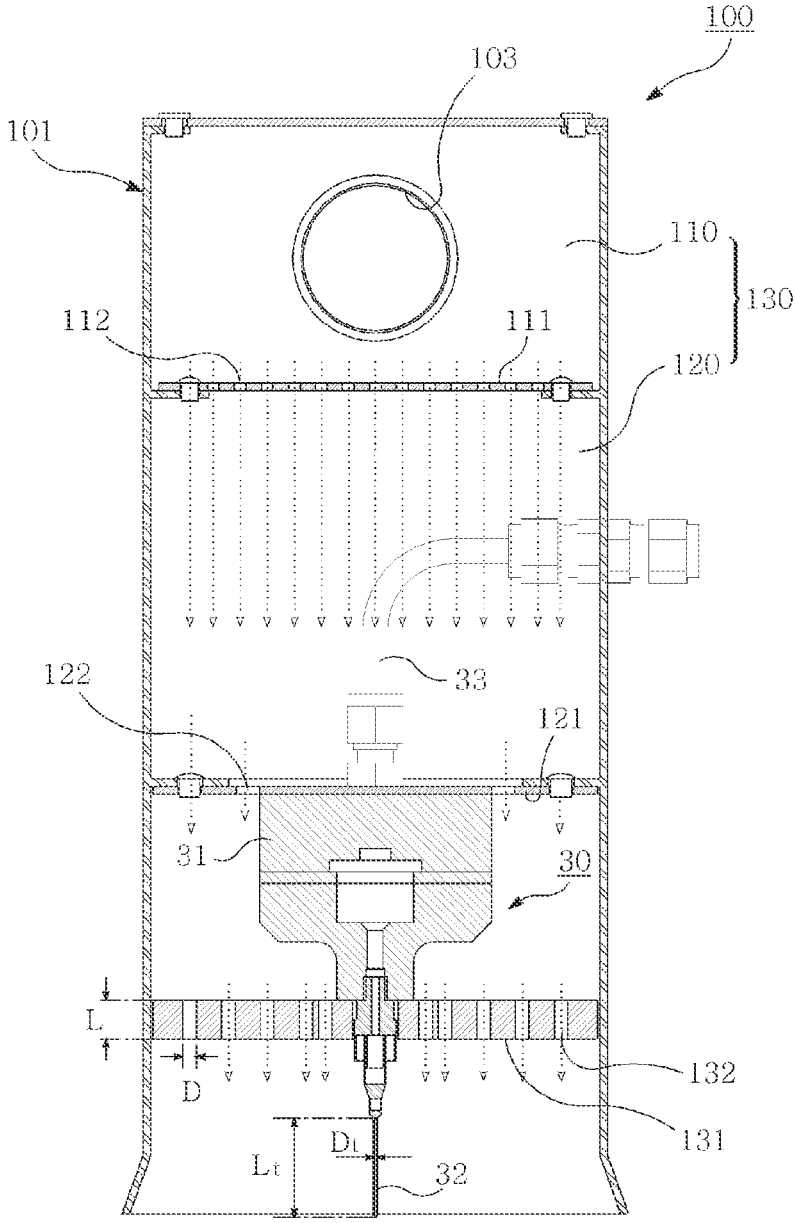
FIG. 3 is a cross-sectional view illustrating a process gas laminar flow distribution device according to an embodiment of the present invention.
Figure 4:
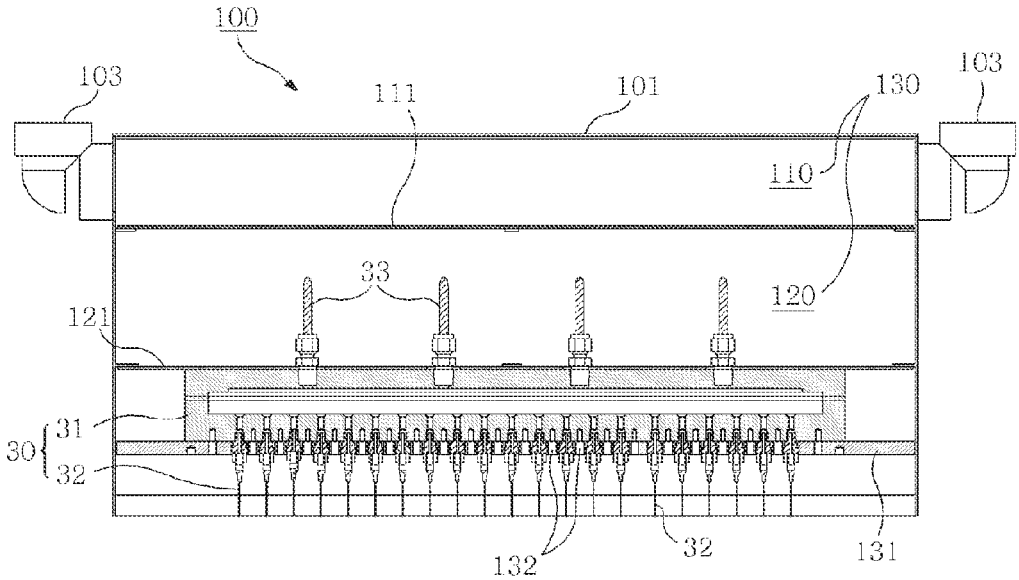
FIG. 4 is a cross-sectional view illustrating a process gas laminar flow distribution device according to an embodiment of the present invention.

Referring to FIGS. 2 to 4, the process gas laminar flow distribution device 100 includes a casing 101 that includes inlets 103 for introducing process gas from the process gas supply unit 20. The nozzle block 31 of the spinning unit 30 is disposed at an inner lower end of the casing 101, whereby a chamber 130 for receiving process gas from the process gas supply unit 20 is formed over the spinning nozzles 32. The process gas laminar flow distribution device 100 includes a laminar flow distribution plate 131 in the lower portion of the casing 101 to constitute a bottom of the chamber 130. The laminar flow distribution plate 131 includes a plurality of discharge holes 132 to fractionate process gas stored in the chamber 130, into laminar flows, and to uniformly distribute the laminar flows to the spinning nozzles 32 extending downward from the lower end of the nozzle block 31.

A distance from the laminar flow distribution plate 131 to an end of the spinning nozzles 32 preferably ranges from 2 cm to 20 cm.

The lower end of the casing 101 vertically extends down to the end of the spinning nozzles 32 so as to maintain process gas, discharged through the discharge holes 132 of the laminar flow distribution plate 131, in a laminar flow state. The lower end of the casing 101 expands outward to induce process gas to spread in a radial shape.

Process gas introduced into the chamber 130 through the inlet 103 is fractionated into laminar flows through the discharge holes 132 of the laminar flow distribution plate 131 at the bottom of the process gas laminar flow distribution device 100, and the laminar flows are distributed to the spinning zone Z through the spinning nozzles 32 under the nozzle block 31. The laminar flows maintain the spinning zone Z at certain temperature and humidity appropriate for a spinning process.

The discharge holes 132 of the laminar flow distribution plate 131 may have a ratio L/D of a length L to a diameter D, which preferably ranges from 2 to 5. The ratio L/D is determined to adjust a flow rate of process gas distributed through each spinning nozzle, within a range from 0.1 $m^3$/min to 1.0 m3/min.

A middle fractionation plate 111 crossing the inside of the casing 101 divides the chamber 130 into a first distribution chamber 110 at the upper side and a second distribution chamber 120 at the lower side. The first distribution chamber 110 communicates with the inlets 103 to receive process gas supplied from the process gas supply unit 20. The middle fractionation plate 111 includes first gas distribution holes 112 equidistantly arrayed on an entire surface thereof, and fractionates process gas introduced into the first distribution chamber 110, through the first gas distribution holes 112 to distribute the process gas to the second distribution chamber 120. As such, process gas is changed to stable laminar flows through the first and second distribution chambers 110 and 120 within the casing 101.

The nozzle block 31 of the spinning unit 30 is coupled to a support plate 121 crossing the inner lower portion of the casing 101, and thus, is fixed within the casing 101. The support plate 121 includes through holes 122 to discharge process gas from the second distribution chamber 120 to the laminar flow distribution plate 131. Process gas from the second distribution chamber 120 is fractionated again into laminar flows through the through holes 122 of the support plate 121.

An electrospinning process according to a preferred embodiment of the present invention was performed under the following process conditions.

A. Spinning Solution

Nylon 66 having a molecular weight of 35,000 Mw was dissolved in formic acid to form a spinning solution having a concentration of 25%.

B. Spinning Unit

The spinning nozzles 32, which have a diameter Dt of 0.52 mm and a length Lt of 12.5 mm, were arrayed with an interval of 20 mm in the longitudinal direction of the nozzle block 31, which has a rectangular parallelepiped shape with a length of 500 mm and a width of 120 mm, and were spaced 250 mm from a collecting unit to form a spinning zone between the spinning nozzles 32 and the collecting unit.

C. Spinning Conditions

A voltage of 50 KV was applied across a spinning unit and the collecting unit to form an electric field in the spinning zone. The spinning solution was supplied at a rate of 6.0 $Kg/cm^2$ to the spinning unit. Process gas having a temperature of 70° C. and a relative humidity of 20% RH was supplied to the spinning zone through a process gas laminar flow distribution device.

Figure 5:
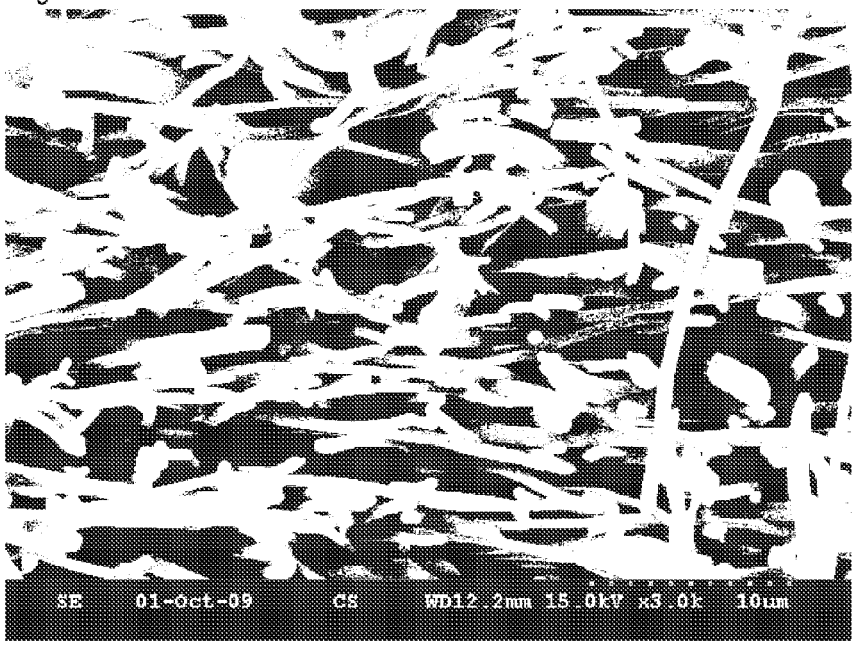
FIG. 5 is an electron microscopic image illustrating a cross section of a nanofiber web produced using an electrospinning apparatus according to the present invention.
Figure 6:
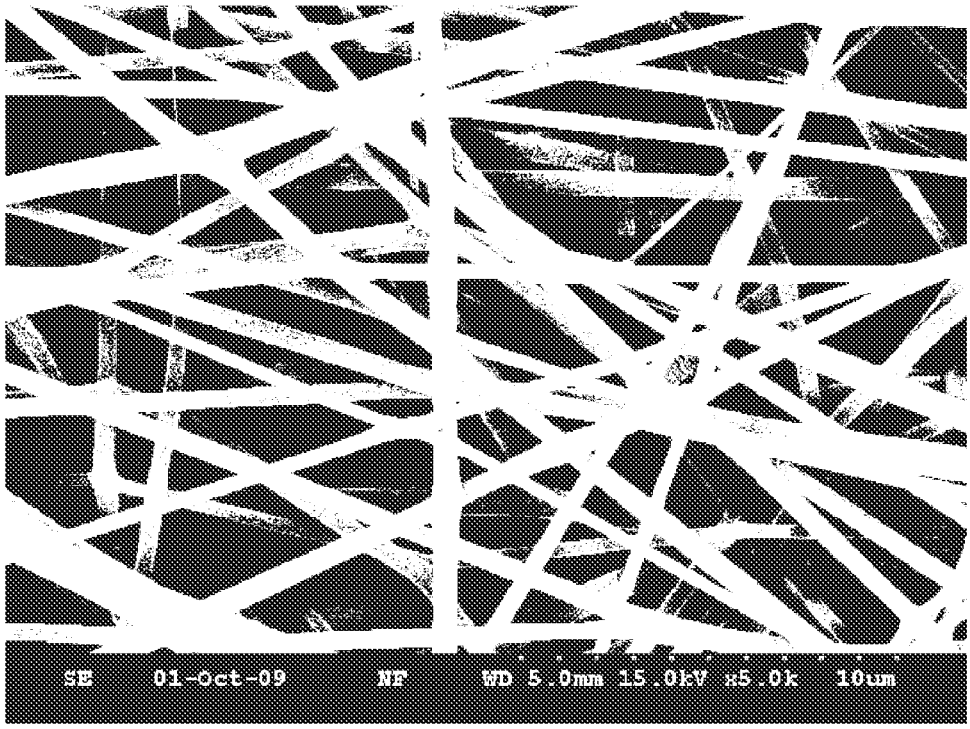
FIG. 6 is an electron microscopic image illustrating an outer surface of a nanofiber web produced using an electrospinning apparatus according to the present invention.
Figure 7:
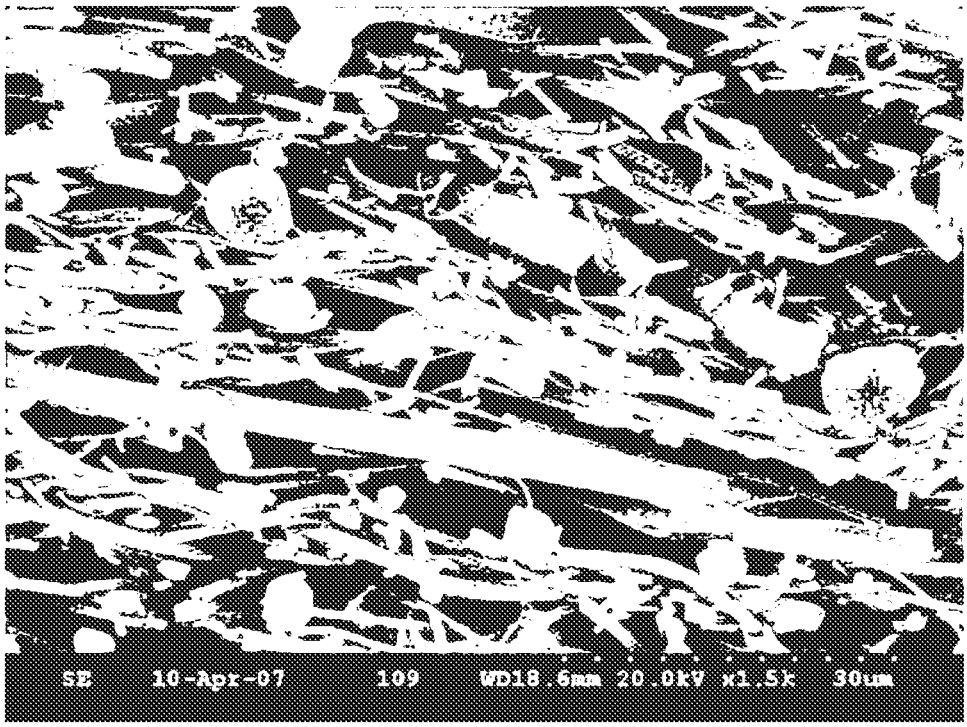
FIG. 7 is an electron microscopic image illustrating a cross-section of a nanofiber web produced using an electroblowing spinning apparatus in the prior art.
Figure 8:
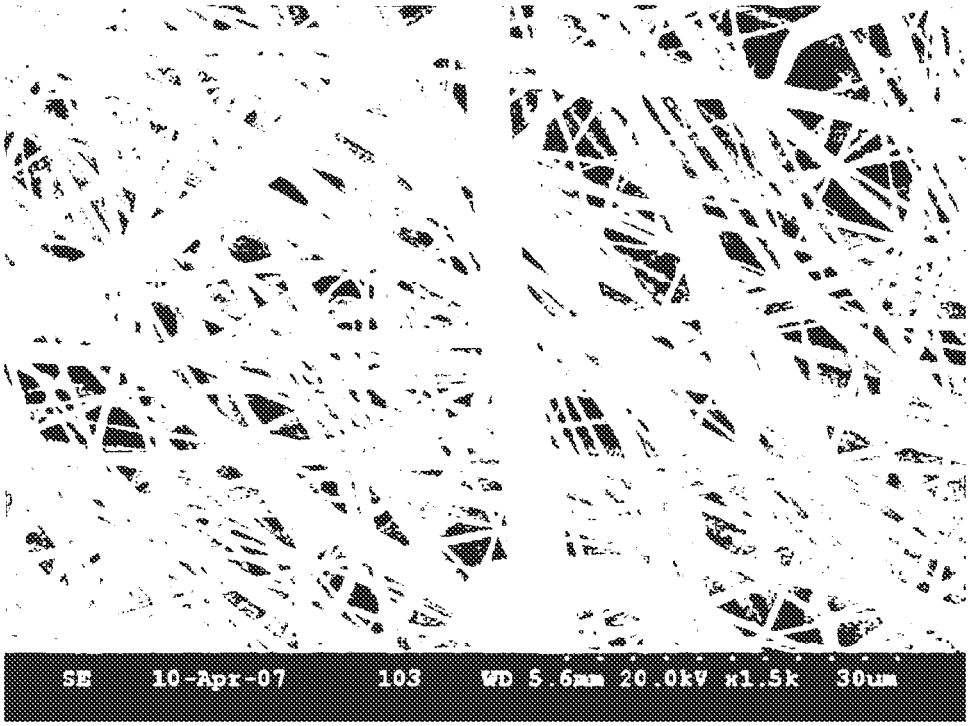
FIG. 8 is an electron microscopic image illustrating an outer surface of a nanofiber web produced using an electroblowing spinning apparatus in the prior art.

Nanofibers having a diameter ranging from 400 nm to 600 nm and a nanofiber web having an available width of 300 mm were produced under the above described conditions. As described above, an electrospinning apparatus according to the present invention produced nanofibers having uniform diameters as illustrated in FIGS. 5 and 6.

This is because laminar flows of process gas maintain the spinning zone Z at temperature and humidity appropriate for nanofiber electrospinning. Thus, when a spinning solution is discharged from the end of the spinning nozzles to the spinning zone Z, viscosity thereof and solvent volatilization are optimally maintained in the spinning zone Z.

The invention claimed is:

1. An electrospinning apparatus for producing nanofibers, comprising:

a spinning solution supply unit (10) for supplying a spinning solution formed by dissolving a nanofiber source in a solvent;

a spinning unit (30) that includes a plurality of spinning nozzles (32) for spinning the spinning solution from the spinning solution supply unit (10) to a spinning zone (Z) under the spinning unit (30), and a nozzle block (31) in which the spinning nozzles (32) are equidistantly arranged and supported;

a nanofiber-collecting unit (40) facing the spinning nozzles (32) of the spinning unit (30) to collect nanofibers spun from the spinning unit (30);

a power supply (50) which forms an electric field in the spinning zone (Z) between the spinning unit (30) and the nanofiber-collecting unit (40) to apply electrical tensile force to the nanofibers spun from the spinning unit (30);

a process gas supply unit (20) which generates and supplies process gas to control temperature and humidity of the spinning zone (Z) to a range appropriate for electrospinning conditions for nanofibers; and a process gas laminar flow distribution device (100) which fractionates the process gas supplied from the process gas supply unit (20), into laminar flows within the process gas laminar flow distribution device (100), and distributes the process gas from an upper portion of the spinning unit (30) to the spinning zone (Z).

2. The electrospinning apparatus according to claim 1, wherein the process gas laminar flow distribution device (100) comprises:

a casing (101) that includes an inlet (103) for introducing the process gas from the process gas supply unit (20) into a chamber (130), wherein the nozzle block (31) of the spinning unit (30) is disposed at an inner lower end of the casing (101), whereby the chamber (130) for receiving the process gas from the process gas supply unit (20) is formed over the spinning nozzles (32); and a laminar flow distribution plate (131) which is disposed in a lower portion of the casing (101), and includes a plurality of discharge holes (132) to fractionate the process gas stored in the chamber (130), into laminar flows, and to uniformly distribute the laminar flows to the spinning nozzles (32) extending downward from a lower end of the nozzle block (31).

3. The electrospinning apparatus according to claim 2, further comprising a middle fractionation plate (111), wherein the middle fractionation plate (111) crosses an inside of the casing (101) to divide the chamber (130) into a first distribution chamber (110) at an upper side thereof and a second distribution chamber (120) at a lower side thereof, the first distribution chamber (110) communicates with the inlet (103), and the middle fractionation plate (111) includes first gas distribution holes (112) through which the process gas from the first distribution chamber (110) are primarily fractionated and distributed to the second distribution chamber (120).

4. The electrospinning apparatus according to claim 3, wherein the nozzle block (31) of the spinning unit (30) disposed within the casing (101) is coupled to a support plate (121) crossing an inner lower portion of the casing (101), and thus, is fixed within the casing (101), and the support plate (121) comprises through holes (122) to discharge the process gas from the chamber (130) to the laminar flow distribution plate (131).

5. The electrospinning apparatus according to claim 2, wherein a distance from a bottom surface of the laminar flow distribution plate (131) to an end of the spinning nozzles 1321 ranges from 2 cm to 20 cm.

6. The electrospinning apparatus according to claim 1, wherein the process gas supplied from the process gas supply unit (20) is controlled to a temperature ranging from 20° C. to 100° C. to 70° C., and to a relative humidity ranging from 10% to 90%.

7. The electrospinning apparatus according to claim 2, wherein the discharge hole (132) of the laminar flow distribution plate (131) has a ratio (L/D) of a length (L) to a diameter (D), which ranges from 2 to 5.

8. The electrospinning apparatus according to claim 2, wherein a lower end of the casing (101) vertically extends down to an end of the spinning nozzles (32) so as to maintain the process gas, discharged through the discharge holes (132) of the laminar flow distribution plate (131), in a laminar flow state.

9. The electrospinning apparatus according to claim 1, wherein the process gas is air.

10. The electrospinning apparatus according to claim 6, wherein the temperature range is from 40° C. to 70° C.

11. The electrospinning apparatus according to claim 6, wherein the relative humidity range is from 20% to 50%.

12. The electrospinning apparatus according to claim 6, wherein the temperature range is from 40° C. to 70° C. and the relative humidity range is from 20% to 50%.

* * * * *